US006823546B1

(12) United States Patent
Hsu

(10) Patent No.: US 6,823,546 B1
(45) Date of Patent: Nov. 30, 2004

(54) ERGONOMICAL MASSAGING PILLOW

(76) Inventor: Ming-Hui Hsu, P.O. Box 82-144, Taipei (TW)

( * ) Notice: Subject to any disclaimer, the term of this patent is extended or adjusted under 35 U.S.C. 154(b) by 0 days.

(21) Appl. No.: 10/759,126

(22) Filed: Jan. 20, 2004

(51) Int. Cl.[7] ..... A47G 9/00
(52) U.S. Cl. ..... 5/636; 5/639; 5/640
(58) Field of Search ..... 5/636, 639, 640, 5/641, 643, 630, 632; D6/601

(56) References Cited

U.S. PATENT DOCUMENTS

| | | | | | |
|---|---|---|---|---|---|
| 3,601,121 | A | * | 8/1971 | Roberts | 601/61 |
| 3,719,185 | A | * | 3/1973 | Hanes | 606/240 |
| 4,233,700 | A | * | 11/1980 | Spann | 5/632 |
| 4,756,035 | A | * | 7/1988 | Beier | 5/640 |
| 4,829,614 | A | * | 5/1989 | Harper | 5/644 |
| 4,916,765 | A | * | 4/1990 | Castronovo, Jr. | 5/640 |
| 5,533,218 | A | * | 7/1996 | Fahy | 5/636 |
| 5,545,199 | A | * | 8/1996 | Hudson | 607/109 |
| 5,682,633 | A | * | 11/1997 | Davis | 5/636 |
| 5,824,013 | A | * | 10/1998 | Allen | 606/240 |
| 5,926,879 | A | * | 7/1999 | Davis | 5/636 |
| 6,061,856 | A | * | 5/2000 | Hoffmann | 5/728 |
| 6,360,388 | B2 | * | 3/2002 | Langer | 5/632 |
| 6,449,788 | B1 | * | 9/2002 | Nichols | 5/636 |
| 2001/0029630 | A1 | * | 10/2001 | Cortese et al. | 5/636 |

FOREIGN PATENT DOCUMENTS

| | | | | | |
|---|---|---|---|---|---|
| GB | 898256 | A | * | 6/1962 | 5/636 |

* cited by examiner

*Primary Examiner*—Robert G. Santos
(74) *Attorney, Agent, or Firm*—Leong C. Lei

(57) ABSTRACT

An ergonomical massaging pillow is disclosed. The pillow comprises a pillow body having at least one side being a cavity and the surface of the pillow body provided with a plurality of extendable slits; and an insertion rod mounted within the cavity and having a plurality of connectable sections with various hardness and softness and the surface of the insertion rod being a plurality of recesses so that a plurality of protrusions are formed on the surface of the insertion rod and the size of the protrusions and the recesses depend greatly on the weight of the spinal cord of the user. When the pillow is used, the protrusions and the slot will be deformed based on the weight of the spinal cord of the user. The harder protrusion provides a massaging effect to the spinal cord of the user.

10 Claims, 12 Drawing Sheets

B–B

ERGONOMICAL MASSAGING PILLOW

BACKGROUND OF THE INVENTION (a) Technical Field of the Invention

The present invention relates to pillow structure with massaging and ergonomically effect, and in particular, a pillow with a pillow body, which deforms to fit the ergonornical requirement of user of different physical sizes.

(b) Brief Description of The Prior Art

FIG. 12 is a conventional pillow, which cannot support the spinal cord at the neck portion of the user, and cannot provide a massaging effect to the spinal cord.

Taiwanese Patent Publication No. 353346 entitled "An Improved Structure of a Pillow" discloses a pillow having elastic body with hollow center allowing ventilation. However, this conventional pillow structure does not provide structure which satisfies the ergonorical requirement. Further, the conventional pillow does not provide massaging effect to the user.

Taiwanese Patent Publication No. 479494 entitled "Pillow Structure" discloses a pillow which provides ergonomical effect to the neck portion and the surface of the pillow is provided with grooves, and the bottom surface of the pillow is provided with elastic recess. The pillow is made from sponge rubber and it is too soft to support and to massage the neck portion of the user.

Taiwanese Patent Publication No. 462268 entitled "Pillow" discloses a pillow having ergonornical effect. Similarly, the soft sponge rubber of the pillow cannot provide the require massaging to the user.

Taiwanese Patent Publication No. 480979 entitled "Adjustable Pillow" discloses a pillow body having a support pillow at the interior thereof and the support pillow is made from sponge rubber. The pillow is too soft which cannot support and massage the neck portion of the user.

Recently, there are pillow available in the market where the pillow can provide support to the neck portion of the user. The deformation of this pillow is small and there is an effect that the head portion is pushed backward. If the user has a bigger physical size, the support of the pillow is insufficient and the head portion will bend forward. This will cause uncomforting to the user. Accordingly, it is an object of the present invention to provide an ergonomical massaging pillow which mitigates the above drawbacks.

SUMMARY OF THE INVENTION

Accordingly, it is an object of the present invention to provide an ergonornical massaging pillow comprising a pillow body having at least one side being a cavity and the surface of the pillow body provided with a plurality of extendable slits; and an insertion rod mounted within the cavity and having a plurality of connectable sections with various hardness and softness and the surface of the insertion rod being a plurality of recesses so that a plurality of protrusions are formed on-the surface of the insertion rod and the size of the protrusions and the recesses depend greatly on the weight of the spinal cord of the user.

Yet another object of the present invention is to provide an ergonomnical massaging pillow, wherein the insertable rod can be positioned within the pillow or withdrawn from the pillow to fulfill the needs of the user.

Still another object of the present invention is to provide an ergonornical massaging pillow, wherein the two sides of the pillow body are provided with a high protrusion and a low protrusion and a recess is formed between the high protrusion and the low protrusion, and a plurality of slots are formed on the high protsusion, the low protrusion and the recess.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
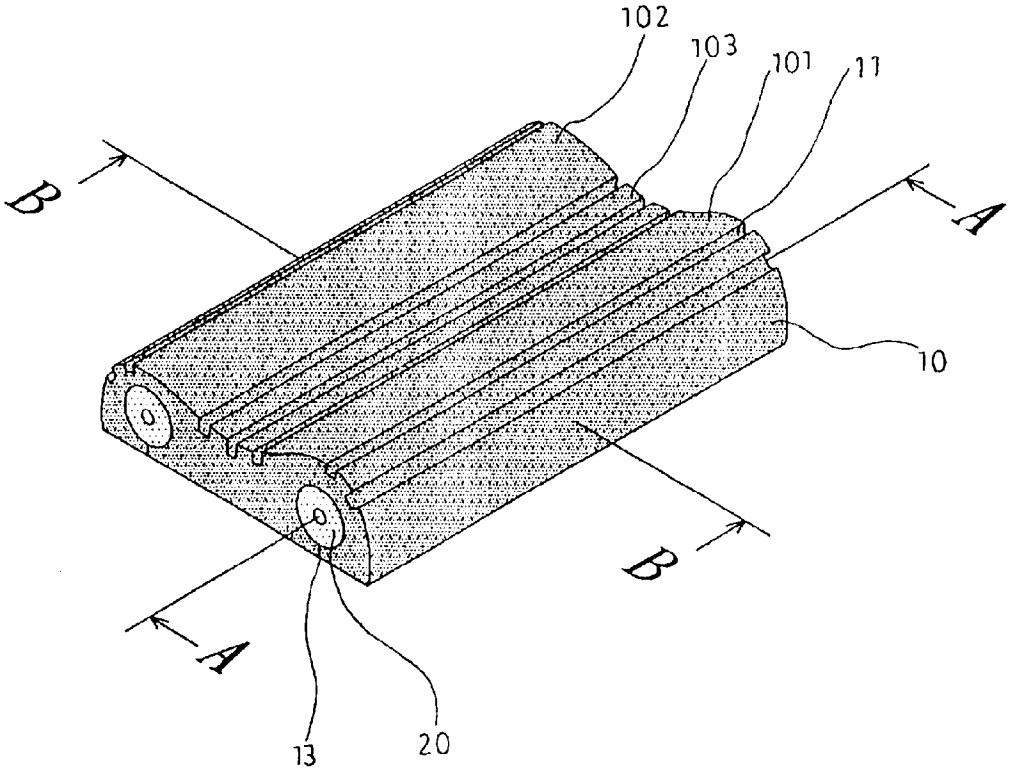
FIG. 1 is a perspective view of the massaging pillow of the present invention.
Figure 2:
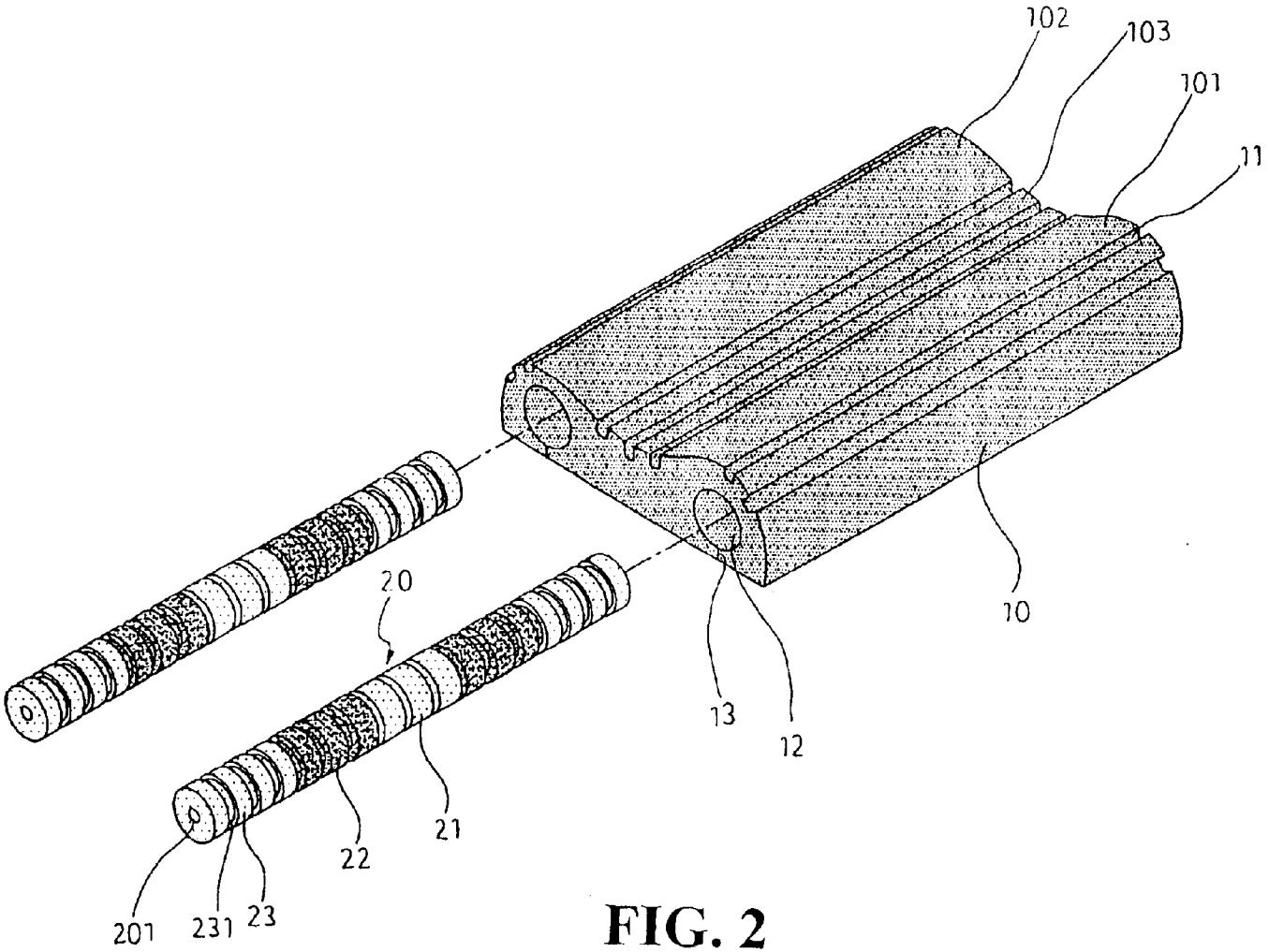
FIG. 2 is an exploded perspective view of the massaging pillow in accordance with the present invention.

Referring to FIGS. 1 and 2, there is shown an ergonomical massaging pillow structure comprising a pillow body 10 and an insertable rod 20. The pillow body 10 is made from sponge rubber or natural rubber and fragrance such as Lavender or rose, etc essence oil so that a fragrant smell is produced from the pillow. The external of the pillow body 10 is covered with a pillow cloth. The surface of the pillow body 10 is provided with curvature and the curvature is divided into three sections. The surfaces of the two sides of the pillow body 10 are respectively formed into high protrusion 101 and low protrusion 102. A recess 103 is formed between the high protrusion 101 and the low protrusion 102. The high protrusion 101 is for those with a bigger size neck portion (for men or for those with a plump body), and the low protrusion 102 is for the women or those with thin physical. The recess 103 is for the skull. A plurality of slots 11 is formed on the high protrusion 101, the low protrusion 102 and the recess 103. Thus, the pillow body 11 can be used to support user with different size of spinal cord. At least one lateral sides of the body 10 is provided with a cavity 12, and a plurality of slits are formed at the connection between the surface of the body 10 and the cavity 12. The slits 13 can be easily extended to open with hands so as to insert an insertion rod 20, as shown in FIG. 3.

The insertion rod 20 is made from sponge rubber or plastic material and is made up of a plurality of sections which can be detached. The insertable rod 20 is mounted within the cavity 12 and consists of a plurality of hard section 22 and soft section 21. The hard section 22 and the soft section 21 can be arranged irregularly or in alternating pattern, and the end faces of the hard section 22 and the soft section 21 are connected with adhesive, or other connectable structure can be used so that the insertable rod 20 can be dismantled or optionally formed with the soft section 21 and the hard section 22 and different colors are used to distinguish the hard section 22 and the soft section 21. A through hole 201 is formed within the body of the insertable rod 20 facilitating the deformation of the insertable rod 20. A protrusion 23 satisfying ergononiical requirement is formed on the surface of the body of the insertable rod 20, and slot 231 is formed between each protrusion 23. In accordance with the present invention, the size of the protrusion 23, the depth of the slot 231 is made differently based on the weight of the spinal cord of the user. That is, if the pillow structure is used to support user of heavy weight, or to withstand a higher pressure, the protrusion 23 has to be larger and the slot 231 has to be deeper so as to satisfy the ergonornical requirement.

The design of the protrusion and slot 231 is based on the equation $\sigma=P/A$ where $\sigma$ is stress, P is pressure, and A is area from the equation, it is understood that the depth has to be large in order to withstand a higher weight exerted.

Figure 3:
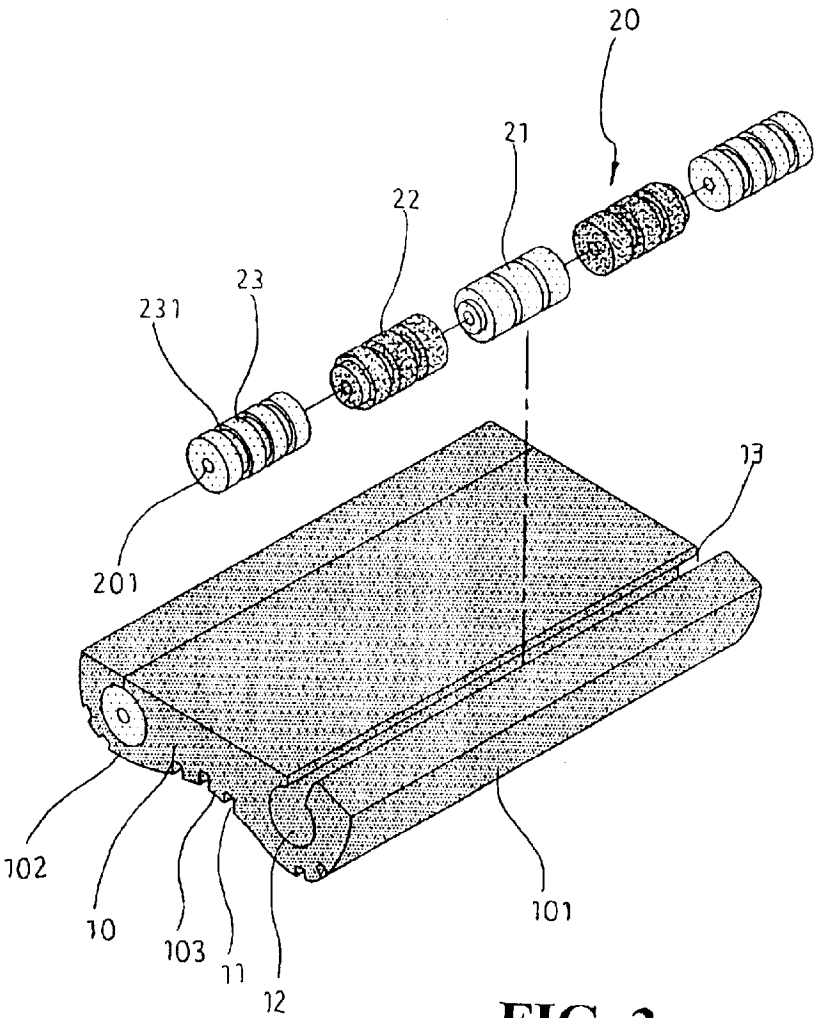
FIG. 3 is a perspective view showing the insertion rod being withdrawn from the pillow of the present invention.
Figure 4:
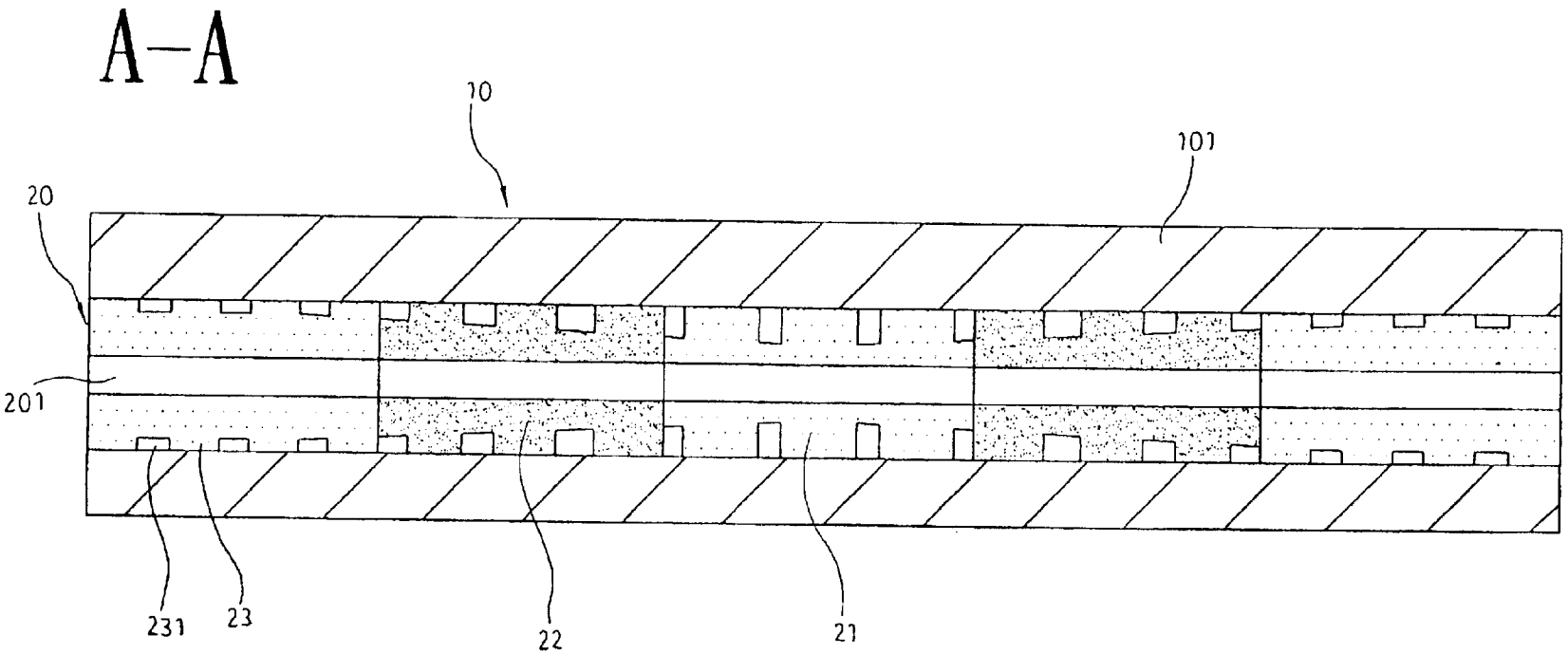
FIG. 4 is a sectional view along line A—A of FIG. 1 of the present invention.
Figure 5:
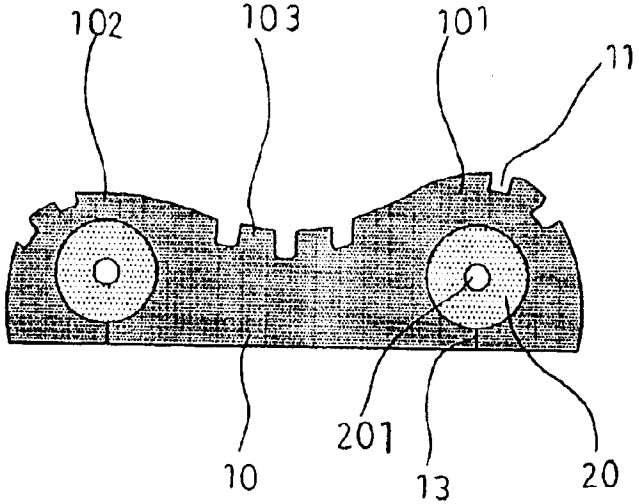
FIG. 5 is a sectional view along line B—B of FIG. 1 of the present invention.

Referring to FIGS. 3, 4 and 5, the slit 13 is forced open with hand and the insertion rod 20 is inserted therein. The insertion rod 20 can be withdrawn if it is not required.

Figure 6:
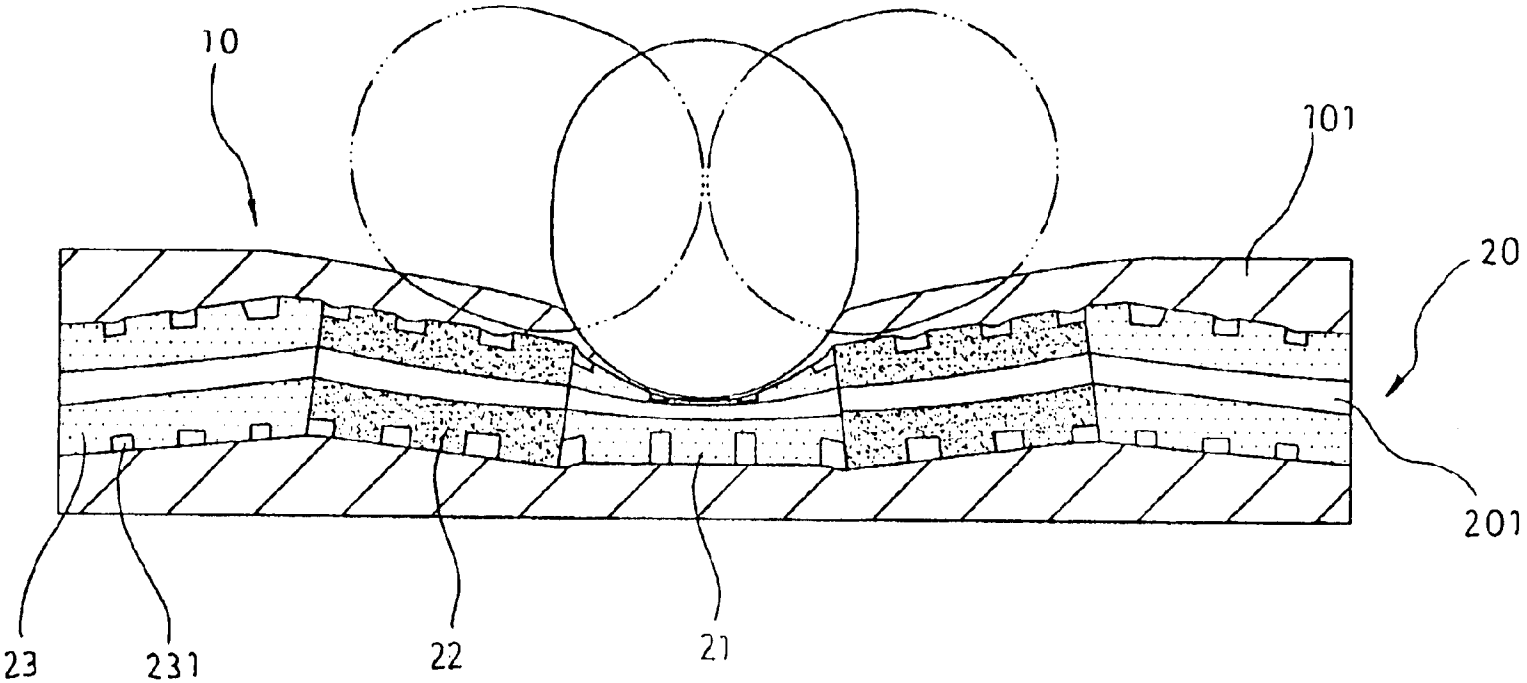
FIG. 6 is a sectional view of the pillow showing the interior of the pillow when the pillow supports the head of the user in accordance with the present invention.
Figure 7:
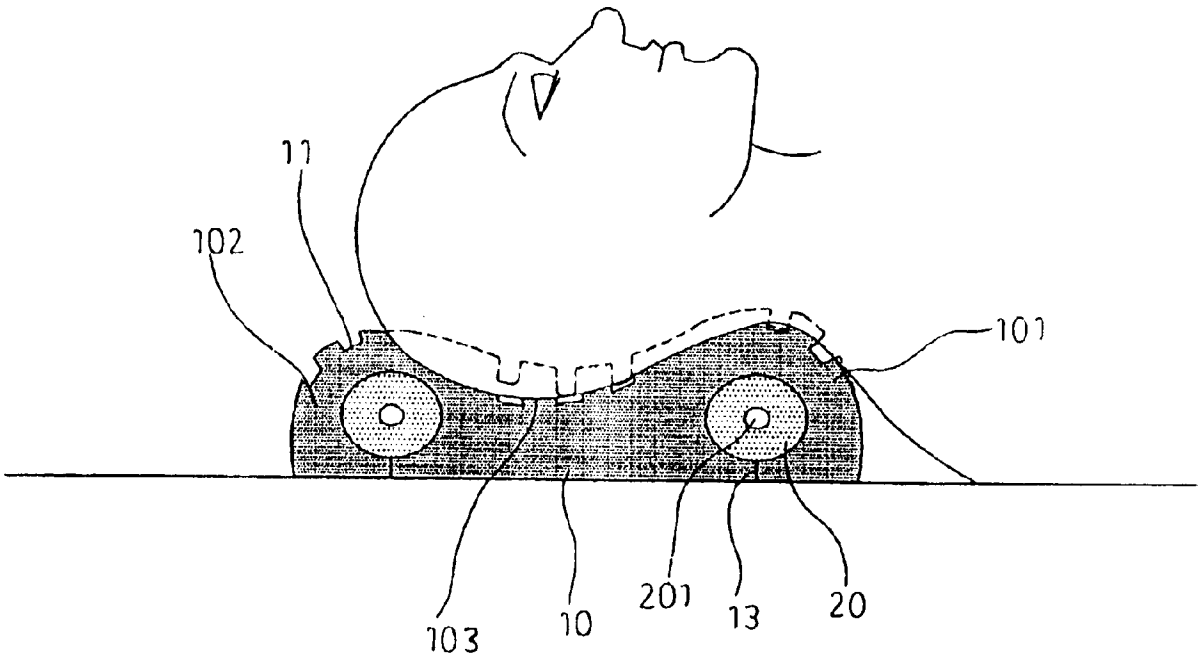
FIG. 7 is a schematic view of the pillow showing the protruded portion of the pillow when the pillow supports the head of the user in accordance with the present invention.

As shown in FIGS. 6 and 7, when the user places the head on the pillow body 10 which has been inserted with an insertion rod 20, the head portion of the user leans against the high protrusion 101, and the protrusion 23 of the soft section 21 and the slot 231 will be deformed to fit the spinal cord of the user. As the two sides of the soft section 21 have a hard section 22, a restraint force is produced and the entire pillow structure will not be fully depressed. The protrusion 23 of the hard section 22 inclines inward and therefore a massaging effect is produced.

The high protrusion 101 of the pillow body 10 can be used for plump size body or for men with a bigger physical, as shown in FIG. 7, and the low protrusion 102, is for women or thinner user. The recess 103 is for the holding of the skull of the user and the slot 11 provides ventilation and deformation. The curvature of the high protrusion 101 is for the various size of head and spinal cord so as to produce an ergonorical effect to the spinal cord of the user.

Figure 8:
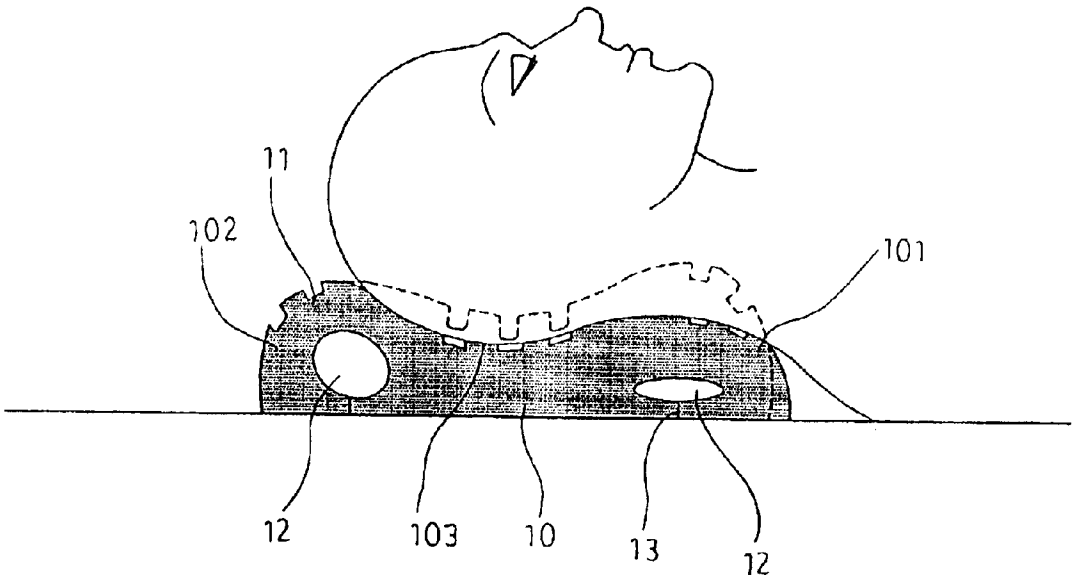
FIG. 8 is a schematic view of the pillow before the insertion rod being inserted into the pillow of the present invention.

As shown in FIG. 8, when the user needs a softer pillow, the insertion rod 20 is withdrawn from the pillow body 10, and the cavity 12 becomes a hole for ventilation.

Figure 9:
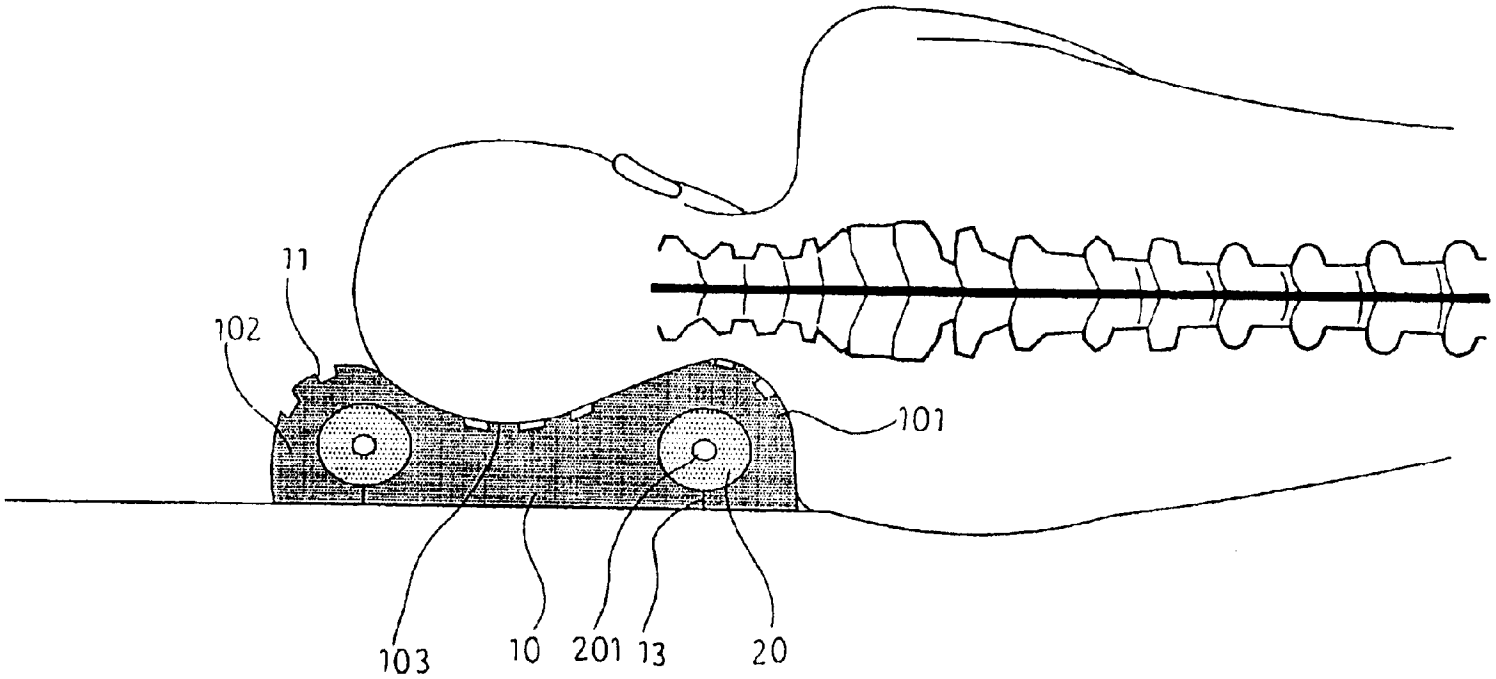
FIG. 9 is a schematic view showing the position of the spinal cord with respect to the pillow in accordance with the present invention.

Referring to FIG. 9, when the user sleeps sideway, the spinal cord at the neck will lean against the hard section 22 of the insertion rod 20, and the hard section 22 will support the spinal cord so that the spinal cord will be kept straight.

Figure 10:
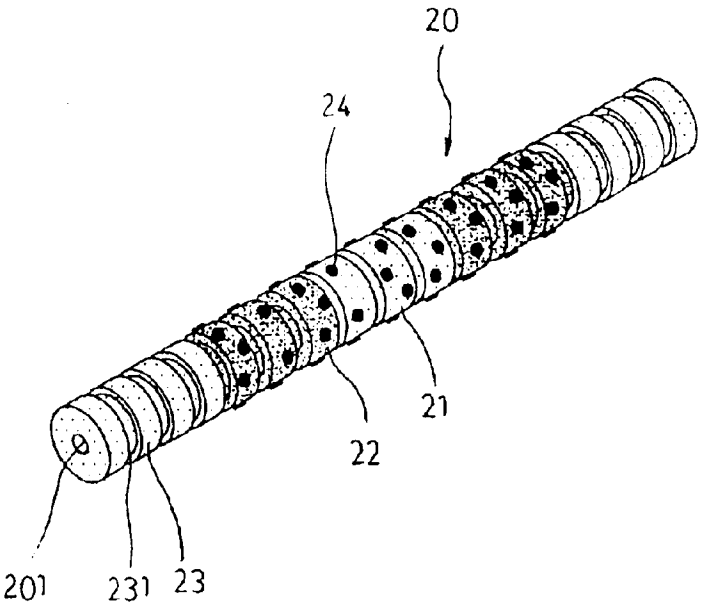
FIG. 10 is a perspective view showing the insertion rod in accordance with the present invention.

As shown in FIG. 10, the protrusion 23 on the insertion rod 20 is mounted with magnetic stones 24 so that the pillow body 10 is provided with magnetism massaging effect.

Figure 11:
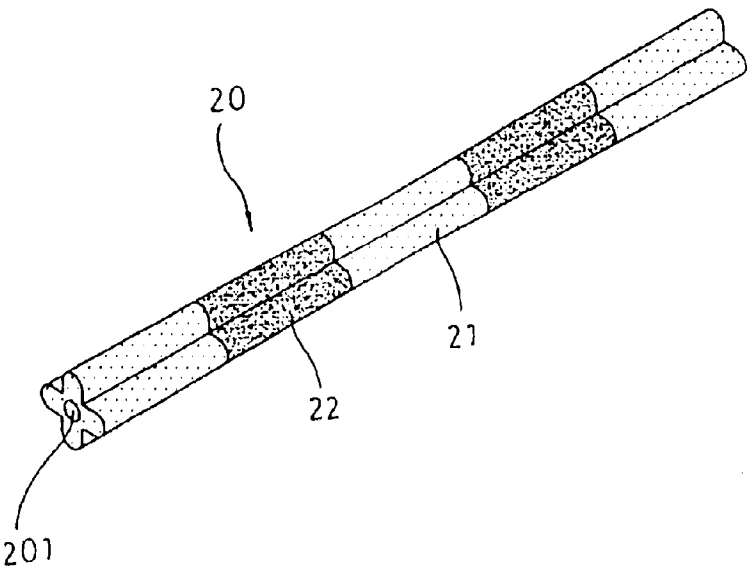
FIG. 11 is a perspective view showing the insertion rod of another preferred embodiment in accordance with the present invention.
Figure 12:
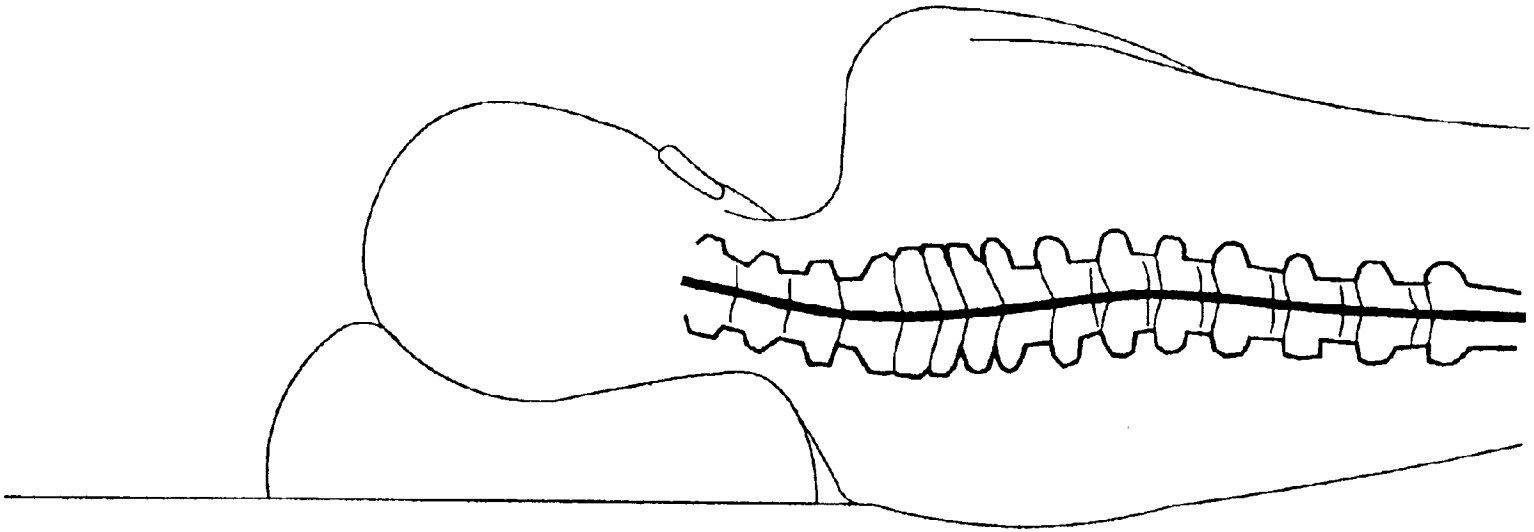
FIG.12 (prior art)
FIG. 12 is a schematic view showing the position of the spinal cord with respect to a conventional pillow.

Referring to FIG. 11, there is shown an example of the protrusion 23 on the insertion rod 20 with several of shapes.

In accordance with the present invention, the pillow body 10 is added with fragrance or refractory material in the course of fabrication.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An ergonomical massaging pillow comprising a pillow body having at least one side being a cavity and the surface of the pillow body provided with a plurality of extendable slits; and an insertion rod mounted within the cavity and having a plurality of connectable sections with various hardness and softness and the surface of the insertion rod being a plurality of recesses so that a plurality of protrusions are formed on the surface of the insertion rod and the size of the protrusions and the recesses depend greatly on the weight of the spinal cord of the user.

2. The ergonomical massaging pillow of claim 1, wherein the hardness and softness of the connectable sections are decorated with different colors.

3. The ergonornical massaging pillow of claim 1, wherein the body of the insertable rod is provided with through hole.

4. The ergonomical massaging pillow of claim 1, wherein the protrusions on the insertable rod is mounted with a plurality of magnetic stones.

5. The ergonorical massaging pillow of claim 1, wherein the protrusions on the insertable rod are of various shapes.

6. The ergonomical massaging pillow of claim 1, wherein the pillow body is added with fragrant and refractory material.

7. The ergonomical massaging pillow of claim 1, wherein the insertable rod is provided with connecting structure, facilitating dismantling and combination of the insertable rod.

8. The ergonornical massaging pillow of claim 1, wherein the insertable rod is made from sponge rubber or plastic material.

9. The ergonomical massaging pillow of claim 8, wherein the insertable rod includes different material for each section on the rod.

10. The ergonorical massaging pillow of claim 1, wherein the two sides of the pillow body are provided with a high protrusion and a low protrusion and a recess is formed between the high protrusion and the low protrusion, and a plurality of slots are formed on the high protrusion, the low protrusion and the recess.

* * * * *